US011316264B2

(12) United States Patent
Ryu et al.

(10) Patent No.: US 11,316,264 B2
(45) Date of Patent: Apr. 26, 2022

(54) ANTENNA DEVICE AND DISPLAY DEVICE COMPRISING THE SAME

(71) Applicants: DONGWOO FINE-CHEM CO., LTD., Jeollabuk-do (KR); POSTECH RESEARCH AND BUSINESS DEVELOPMENT FOUNDATION, Gyeongsangbuk-do (KR)

(72) Inventors: Han Sub Ryu, Gyeongsangbuk-do (KR); Yun Seok Oh, Gyeonggi-do (KR); Yoon Ho Huh, Seoul (KR); Won Bin Hong, Seoul (KR)

(73) Assignees: DONGWOO FINE-CHEM CO., LTD., Jeollabuk-do (KR); POSTECH RESEARCH AND BUSINESS DEVELOPMENT FOUNDATION, Gyeongsangbuk-do (KR)

( * ) Notice: Subject to any disclaimer, the term of this patent is extended or adjusted under 35 U.S.C. 154(b) by 0 days.

(21) Appl. No.: 17/014,062

(22) Filed: Sep. 8, 2020

(65) Prior Publication Data

US 2020/0403301 A1 Dec. 24, 2020

Related U.S. Application Data

(63) Continuation of application No. PCT/KR2019/002517, filed on Mar. 5, 2019.

(30) Foreign Application Priority Data

Mar. 6, 2018 (KR) ..... 10-2018-0026379

(51) Int. Cl.
*H01Q 1/38* (2006.01)
*H01Q 1/24* (2006.01)
(Continued)

(52) U.S. Cl.
CPC ..... *H01Q 1/38* (2013.01); *H01Q 1/243* (2013.01); *H01Q 1/42* (2013.01); *H01Q 1/46* (2013.01)

(58) Field of Classification Search
CPC ..... H01Q 1/38; H01Q 1/243; H01Q 1/42
(Continued)

(56) References Cited

U.S. PATENT DOCUMENTS

2012/0229345 A1 9/2012 Takaki et al.
2015/0255856 A1* 9/2015 Hong ..... H01Q 9/0407 343/702

(Continued)

FOREIGN PATENT DOCUMENTS

JP 2000-138512 A 5/2000
JP 3106547 U 1/2005

(Continued)

OTHER PUBLICATIONS

International Search Report for PCT/KR2019/002517 dated Jun. 12, 2019.

(Continued)

*Primary Examiner* — Peguy Jean Pierre
(74) *Attorney, Agent, or Firm* — The PL Law Group, PLLC

(57) ABSTRACT

An antenna device according to an embodiment of the present invention includes a dielectric layer, and an antenna pattern disposed on the dielectric layer. The antenna pattern includes a mesh structure in which unit cells defined by a plurality of electrode lines are assembled. A minimum distance between opposite sides facing each other in the unit cell is from 20 μm to 225 μm, and a line width of the electrode line is from 0.5 μm to 5 μm. A visual recognition of electrodes may be suppressed and a signal sensitivity may be enhanced by using the unit cell structure.

16 Claims, 6 Drawing Sheets

(51) Int. Cl.
*H01Q 1/42* (2006.01)
*H01Q 1/46* (2006.01)

(58) Field of Classification Search
USPC ..... 343/702
See application file for complete search history.

(56) References Cited

U.S. PATENT DOCUMENTS

| | | | | |
|---|---|---|---|---|
| 2016/0093939 | A1* | 3/2016 | Kim | H01Q 1/243 343/720 |
| 2017/0149111 | A1* | 5/2017 | Yosui | H01P 3/08 |

FOREIGN PATENT DOCUMENTS

| | | | |
|---|---|---|---|
| JP | 2006-186742 | A | 7/2006 |
| JP | 2007-012042 | A | 1/2007 |
| JP | 2009-296256 | A | 12/2009 |
| JP | 2016-219999 | A | 12/2016 |
| JP | 2017-175540 | A | 9/2017 |
| KR | 10-2009-0072100 | A | 7/2009 |
| KR | 10-2013-0095451 | A | 8/2013 |
| KR | 10-2015-0104509 | A | 9/2015 |
| KR | 10-2016-0050467 | A | 5/2016 |
| KR | 10-2016-0080444 | A | 7/2016 |
| KR | 10-2017-0089198 | A | 8/2017 |
| WO | WO 2006/106759 | A | 10/2006 |
| WO | 2017/131362 | A1 | 8/2017 |

OTHER PUBLICATIONS

Office action dated Apr. 13, 2020 from Korean Patent Office in a counterpart Korean Patent Application No. 10-2018-0026379 (all the cited references are listed in this IDS.) (English translation is also submitted herewith.).

Office action dated Nov. 16, 2021 from Japan Intellectual Property Office in a counterpart Japanese Patent Application No. 2020-546884(all the cited references are listed in this IDS.) (English translation is also submitted herewith.).

* cited by examiner

ANTENNA DEVICE AND DISPLAY DEVICE COMPRISING THE SAME

CROSS REFERENCE TO RELATED APPLICATIONS AND CLAIM OF PRIORITY

The present application is a continuation application to International Application No. PCT/KR2019/002517 with an International Filing Date of Mar. 5, 2019, which claims the benefit of Korean Patent Application No. 10-2018-0026379 filed on Mar. 6, 2018 at the Korean Intellectual Property Office, the disclosures of which are incorporated by reference herein in their entirety.

BACKGROUND

1. Field

The present invention relates to an antenna device and a display device including the same. More particularly, the present invention relates to an antenna device including an electrode pattern and a display device including the same.

2. Description of the Related Art

As information technologies have been developed, a wireless communication technology such as Wi-Fi, Bluetooth, etc., is combined with a display device in, e.g., a smartphone form. In this case, an antenna may be combined with the display device to provide a communication function.

As mobile communication technologies have been rapidly developed, an antenna capable of operating a high or ultra-high frequency communication is needed in the display device. Further, as a thin-layered display device with high transparency and high resolution such as a transparent display, a flexible display, etc., is being developed recently, development of the antenna having improved transparency and flexibility may also be needed.

In a recent display device with a large-scaled screen, a space or an area for a bezel portion or a light-shielding portion is decreased. In this case, a space or an area for the antenna is also limited, and thus a radiation pattern for a signal transmission and reception included in the antenna may overlap a display region of the display device. Thus, an image from the display device may be shielded by the radiation pattern of the antenna or the radiation pattern may be recognized by a user to degrade an image quality.

SUMMARY

According to an aspect of the present invention, there is provided an antenna device having improved visual property and signaling efficiency.

According to an aspect of the present invention, there is provided a display device including an antenna device with improved visual property and signaling efficiency.

(1) An antenna device, including: a dielectric layer; an antenna pattern disposed on a top surface of the dielectric layer, the antenna pattern including a mesh structure in which unit cells defined by a plurality of electrode lines are assembled, wherein a minimum distance between opposite sides facing each other in the unit cell is from 20 μm to 225 μm, and a line width of the electrode line is from 0.5 μm to 5 μm.

(2) The antenna device according to the above (1), wherein a minimum distance between opposite sides facing each other in the unit cell is from 50 μm to 196 μm.

(3) The antenna device according to the above (1), wherein the plurality of electrode lines include first electrode lines and second electrode lines intersecting each other.

(4) The antenna device according to the above (3), wherein the unit cell has a rhombus shape.

(5) The antenna device according to the above (1), further including a dummy electrode arranged around the antenna pattern.

(6) The antenna device according to the above (5), wherein the dummy electrode includes the same mesh structure as that of the antenna pattern.

(7) The antenna device according to the above (6), wherein the antenna pattern and the dummy electrode include the same metal.

(8) The antenna device according to the above (1), wherein the antenna pattern includes a radiation pattern, a transmission line connected to the radiation pattern and a pad electrode connected to an end portion of the transmission line.

(9) The antenna device according to the above (8), wherein the radiation pattern includes the mesh structure, and the pad electrode has a solid structure.

(10) The antenna device according to the above (9), wherein the pad electrode is disposed at an upper level from the radiation pattern and the transmission line, and the antenna device further includes a contact electrically connecting the pad electrode and the transmission line.

(11) An antenna device, comprising: a dielectric layer; and a first electrode layer on a top surface of the dielectric layer, the first electrode layer comprising first electrode lines and second electrode lines intersecting each other, the first electrode layer having a mesh structure in which unit cells defined by the first electrode lines and second electrode lines are assembled, wherein a minimum distance between opposite sides facing each other in the unit cell is from 20 μm to 225 μm, and a line width of the electrode line is from 0.5 μm to 5 μm.

(12) The antenna device according to the above (11), further including a pad electrode connected to the first electrode layer.

(13) The antenna device according to the above (12), wherein the first electrode layer includes a radiation pattern having the mesh structure and a transmission line connected to the radiation pattern; and the pad electrode is connected to an end portion of the transmission line and has a solid structure.

(14) The antenna device according to the above (13), wherein the pad electrode is disposed at an upper level from the radiation pattern and the transmission line; and

(15) The antenna device according to the above (14), further including: an insulating interlayer formed on the dielectric layer to cover the first electrode layer; and a contact formed through the insulating interlayer to electrically connect the pad electrode and the transmission line, wherein the pad electrode is disposed on the insulating interlayer to be in contact with the contact.

(16) The antenna device according to the above (15), further including: a protective layer on the insulating interlayer to cover the pad electrode.

(17) The antenna device according to the above (11), further including: a second electrode layer on a bottom surface of the dielectric layer.

(18) A display device comprising the antenna device according to the embodiments as described above.

An antenna device according to an embodiment of the present invention may include a radiation pattern having a mesh structure in which unit cells having, e.g., a diamond or rhombus shapes are assembled. A minimum distance between opposing sides of the unit cell in the radiation pattern may be adjusted to prevent visibility of electrode lines included in the radiation pattern. Additionally, resistance and transmittance may be controlled by adjusting a line width of the electrode line.

The antenna device may be inserted or mounted in a front portion of a display device, and the radiation pattern may be prevented from being viewed by a user of the display device. Further, the line width of the electrode line may be adjusted to improve transmittance and increase signal sensitivity so that degradation of an image quality of the display device may be minimized.

The antenna device may include a metal mesh structure so that flexibility may be improved and may be effectively applied to a flexible display device.

DETAILED DESCRIPTION OF THE EMBODIMENTS

According to exemplary embodiments of the present invention, there is provided an antenna device that includes a radiation pattern including a mesh structure and provides improved transmittance and signal sensitivity while reducing a visual recognition of electrodes.

The antenna device may be, e.g., a microstrip patch antenna fabricated in the form of a transparent film. For example, the antenna device may be applied to a device for high frequency band or ultra-high frequency band (e.g., 3G, 4G, 5G or more) mobile communications.

According to an exemplary embodiment of the present invention, there is also provided a display device including the antenna device. However, an application of the antenna device is not limited to the display device, and the antenna device may be applied to various objects or structures such as a vehicle, a home electronic appliance, an architecture, etc.

Hereinafter, the present invention will be described in detail with reference to the accompanying drawings. However, those skilled in the art will appreciate that such embodiments described with reference to the accompanying drawings are provided to further understand the spirit of the present invention and do not limit subject matters to be protected as disclosed in the detailed description and appended claims.

Figure 1:
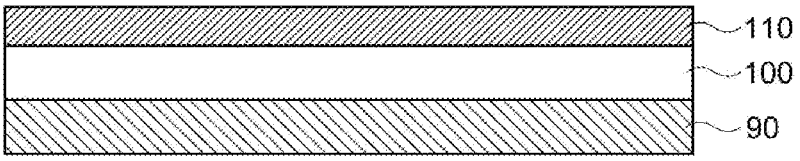
FIGS. 1 and 2 are a schematic cross-sectional view and a schematic top planar view, respectively, illustrating an antenna device in accordance with an exemplary embodiment.
Figure 2:
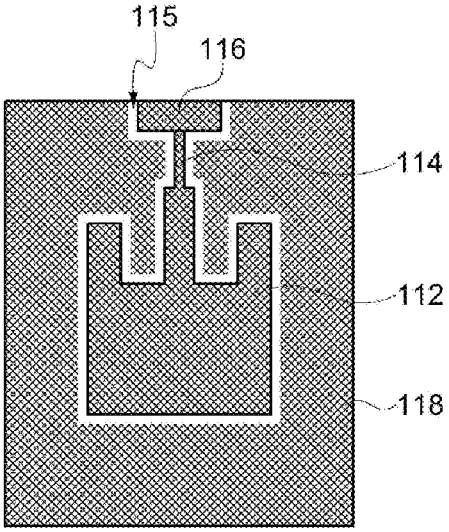

FIGS. 1 and 2 are a schematic cross-sectional view and a schematic top planar view, respectively, illustrating an antenna device in accordance with an exemplary embodiment.

Referring to FIGS. 1 and 2, an antenna device according to an exemplary embodiment may include a dielectric layer 100 and a first electrode layer 110 disposed on the dielectric layer 100. In some embodiments, a second electrode layer 90 may be further included on a bottom surface of the dielectric layer 100.

The dielectric layer 100 may include an insulating material having a predetermined dielectric constant. The dielectric layer 100 may include, e.g., an inorganic insulating material such as glass, silicon oxide, silicon nitride, a metal oxide, etc., or an organic insulating material such as an epoxy resin, an acrylic resin, an imide-based resin, etc. The dielectric layer 100 may function as a film substrate of the antenna device on which the first electrode layer 110 may be formed.

For example, a transparent film may serve as the dielectric layer 100. For example, the transparent film may include a polyester-based resin such as polyethylene terephthalate, polyethylene isophthalate, polyethylene naphthalate and polybutylene terephthalate; a cellulose-based resin such as diacetyl cellulose and triacetyl cellulose; a polycarbonate-based resin; an acrylic resin such as polymethyl (meth) acrylate and polyethyl (meth)acrylate; a styrene-based resin such as polystyrene and an acrylonitrile-styrene copolymer; a polyolefin-based resin such as polyethylene, polypropylene, a cycloolefin or polyolefin having a norbornene structure and an ethylene-propylene copolymer; a vinyl chloride-based resin; an amide-based resin such as nylon and an aromatic polyamide; an imide-based resin; a polyether-sulfone-based resin; a sulfone-based resin; a polyether ether ketone-based resin; a polyphenylene sulfide resin; a vinyl alcohol-based resin; a vinylidene chloride-based resin; a vinyl butyral-based resin; an allylate-based resin; a polyoxymethylene-based resin; a urethane or acryl urethane-based resin; a silicone-based resin, etc. These may be used alone or in a combination thereof.

In some embodiments, an adhesive film including, e.g., a pressure sensitive adhesive (PSA), an optically clear adhesive (OCA), or the like may be included in the dielectric layer 100.

In some embodiments, the dielectric constant of the dielectric layer 100 may be adjusted in a range from about 1.5 to about 12. If the dielectric constant exceeds about 12, a driving frequency may be excessively reduced, and an antenna driving in a desired high frequency band may not be realized.

As illustrated in FIG. 2, the first electrode layer 110 may include an antenna pattern including a radiation pattern 112 and a transmission line 114. The antenna pattern or the first electrode layer 110 may further include a pad electrode 116 connected to an end portion of the transmission line 114.

In some embodiments, the first electrode layer 110 may further include a dummy electrode 118 arranged around the antenna pattern.

The first electrode layer 110 may include silver (Ag), gold (Au), copper (Cu), aluminum (Al), platinum (Pt), palladium (Pd), chromium (Cr), titanium (Ti), tungsten (W), niobium (Nb), tantalum (Ta), vanadium (V), iron (Fe), manganese (Mn), cobalt (Co), nickel (Ni), zinc (Zn), tin (Sn), molybdenum (Mo), calcium (Ca) or an alloy containing at least one of the metals. These may be used alone or in a combination thereof.

For example, the radiation pattern 112 may include silver or a silver alloy to have a low resistance. For example, the radiation electrode 112 may include a silver-palladium-copper (APC) alloy.

In an embodiment, the radiation pattern 112 may include copper (Cu) or a copper alloy in consideration of low resistance and pattern formation with a fine line width. For example, the radiation pattern 112 may include a copper-calcium (Cu—Ca) alloy.

In some embodiments, the first electrode layer 110 may include a transparent metal oxide such as indium tin oxide (ITO), indium zinc oxide (IZO), indium zinc tin oxide (ITZO), or zinc oxide (ZnOx).

For example, the first electrode layer 110 may have a multi-layered structure including a metal or alloy layer and a transparent metal oxide layer.

In an exemplary embodiment, the radiation pattern 112 of the antenna pattern may include a mesh structure. Accordingly, transmittance of the radiation pattern 112 may be increased, and flexibility of the antenna device may be improved. Thus, the antenna device may be effectively applied to a flexible display device.

In some embodiments, the dummy electrode 118 may also include a mesh structure, and a mesh structure substantially the same as that of the mesh structure included in the radiation pattern 112 may be included in the dummy electrode 118. In some embodiments, the dummy electrode 118 and the radiation pattern 112 may include the same metal.

The transmission line 114 may extend from one end portion of the radiation pattern 112 and may be electrically connected to the pad electrode 116. For example, the transmission line 114 may extend from a protrusion formed in a central portion of the radiation pattern 112.

In an embodiment, the transmission line 114 may include a conductive material substantially the same as that of the radiation pattern 112, and may be formed through substantially the same etching process. In this case, the transmission line 114 may serve as a substantially single member being integrally connected with the radiation pattern 112.

In some embodiments, the transmission line 114 and the radiation pattern 112 may include substantially the same mesh structure.

The pad electrode 116 may be electrically connected to the radiation pattern 112 through the transmission line 114, and may electrically connect a driving circuit unit (e.g., an IC chip) and the radiation pattern 112 with each other.

For example, a circuit board such as a flexible circuit board (FPCB) may be bonded on the pad electrode 116, and the driving circuit unit may be disposed on the flexible circuit board. Accordingly, signal transmission and reception may be implemented between the antenna pattern and the driving circuit unit. The driving circuit unit may be mounted directly on the FPCB. Alternatively, the driving circuit unit may be mounted on the FPCB via an intermediate circuit board such as a rigid circuit board.

In some embodiments, the pad electrode 116 may be disposed at the same layer or at the same level as that of the radiation pattern 112. In this case, the pad electrode 116 may also include a mesh structure substantially the same as that of the radiation pattern 112.

As described above, the dummy electrode 118 may include substantially the same mesh structure as that of the radiation pattern 112, and may be electrically or physically separated from the antenna pattern and the pad electrode 116.

For example, a separation region 115 may be formed along a side line or a profile of the antenna pattern to separate the dummy electrode 118 and the antenna pattern from each other.

As described above, the antenna pattern may be formed to include the mesh structure so that transmittance of the antenna device may be improved. In an embodiment, while utilizing the mesh structure, electrode lines included in the mesh structure may be formed of a low-resistance metal such as copper, silver, an APC alloy, an CuCa alloy thereby suppressing a resistance increase. Thus, a transparent film antenna having low resistance and high-sensitivity may be effectively implemented.

Further, the dummy electrodes 118 having the same mesh structure may be arranged around the antenna pattern so that the antenna pattern may be prevented from being recognized to a user of the display device due to a local difference of an electrode arrangement.

One antenna pattern is only illustrated in FIG. 2 for convenience of descriptions, but a plurality of the antenna patterns may be arranged in an array form on the dielectric layer 100.

In some embodiments, the second electrode layer 90 may serve as a ground layer of the antenna device. For example, a capacitance or an inductance may be formed between the radiation pattern 112 and the second electrode layer 90 in a thickness direction of the antenna device by the dielectric layer 100, so that a frequency band for an antenna sensing or an antenna driving may be adjusted. For example, the antenna device may serve as a vertical radiation antenna.

The second electrode layer 90 may include a metal that is substantially the same as or similar to that of the first electrode layer 110. In an embodiment, a conductive member of the display device on which the antenna element is mounted may serve as the second electrode layer 90.

The conductive member may include, e.g., a gate electrode of a thin film transistor (TFT) included in a display panel, various wiring such as a scan line or a data line or various electrodes such as a pixel electrode and a common electrode.

In an embodiment, e.g., various structures including a conductive material disposed under the display panel may serve as the second electrode layer 90. For example, a metal plate (e.g., a stainless steel plate such as a SUS plate), a pressure sensor, a fingerprint sensor, an electromagnetic wave shielding layer, a heat dissipation sheet, a digitizer, etc., may serve as the second electrode layer 90.

Figure 3:
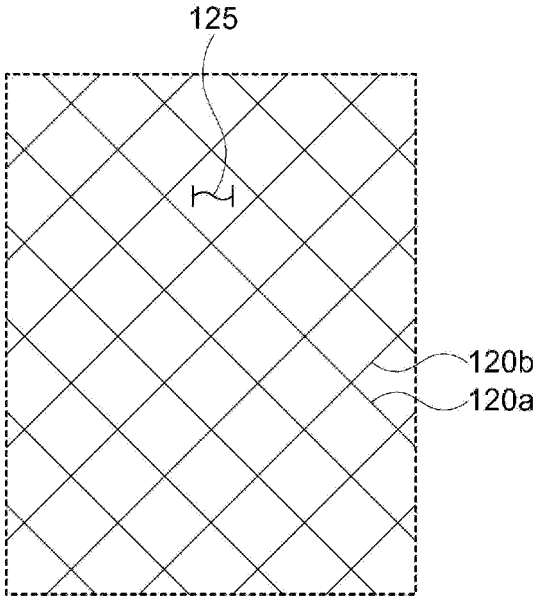
FIGS. 3 and 4 are schematic top planar views illustrating a mesh structure and a unit cell, respectively, of an antenna device in accordance with an exemplary embodiment.
Figure 4:
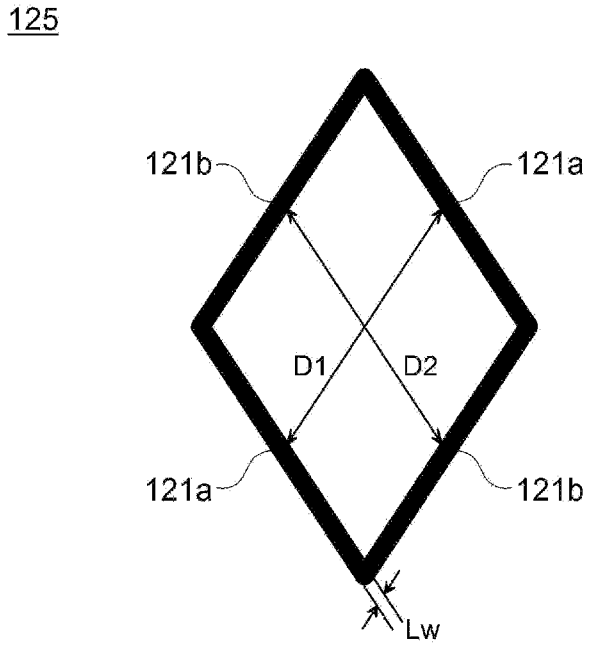

FIGS. 3 and 4 are schematic top planar views illustrating a mesh structure and a unit cell, respectively, of an antenna device in accordance with an exemplary embodiment. For example, FIG. 3 shows a mesh structure at an inside of an antenna pattern included in the antenna device.

Referring to FIG. 3, the mesh structure included in the antenna pattern may be defined by electrode lines intersecting each other.

The mesh structure may include a first electrode line **120*a* and a second electrode line 120*b* divided based on an extension direction. The first and second electrode lines 120*a* and 120*b* may extend in directions intersecting each other, and a plurality of the first electrode lines 120*a* and a plurality of second electrode lines 120*b* may cross each other to define the mesh structure in which unit cells 125** may be assembled.

The unit cell 125 may be defined by two adjacent first electrode lines 120*a* and two adjacent second electrode lines 120*b* intersecting each other, and may have a diamond or rhombus shape.

Referring to FIG. 4, the unit cell 125 may have a rhombus shape and may include a pair of first sides 121*a* facing each other and a pair of second sides 121*b* facing each other. The first side 121*a* may be originated from the first electrode line 120*a*, and the second side 121*b* may be originated from the second electrode line 120*b*.

A minimum distance between opposite sides facing each other may be defined as a distance D1 between the first sides 121*a* or a distance D2 between the second sides 121*b*. In an embodiment, the distance D1 between the first sides 121*a* and the distance D2 between the second sides 121*b* may be the same.

In an exemplary embodiment, the minimum distance between the opposite sides facing each other may be about 225 μm or less. In this case, an overlap or an interference of diffraction peaks generated from each side of the unit cell 125 may be reduced, so that the mesh structure or the electrode lines may be prevented from being seen to the user.

If the minimum distance between the opposite sides facing each other is excessively decreased, an inner space in the unit cell 125 may be reduced to cause an entire reduction of a transmittance of the antenna device.

In consideration of the transmittance and suppression of visible recognition of the electrodes, the minimum distance between the opposite sides may be from about 20 to about 225 μm, and preferably from about 50 to about 196 μm.

In an exemplary embodiment, a line width Lw of each side of the unit cell 125 or the electrode line may be from about 0.5 to about 5 μm. If the line width Lw of the electrode line is less than about 0.5 μm, a signal loss rate of the antenna device may be excessively increased, and effective driving properties of the antenna device may not be obtained. If the line width Lw of the electrode line exceeds about 5 μm, the transmittance of the antenna device may be degraded.

The minimum distance between the opposite sides of the unit cell 125 and the line width of each electrode line may be adjusted as described above, the visual recognition of the electrode may be blocked while maintaining the transmittance, and an effective signal sensitivity of the antenna device may be achieved.

As described above, the unit cell 125 may have, e.g., the rhombus shape, and may have another convex polygonal shape such as a hexagonal shape.

Figure 5:
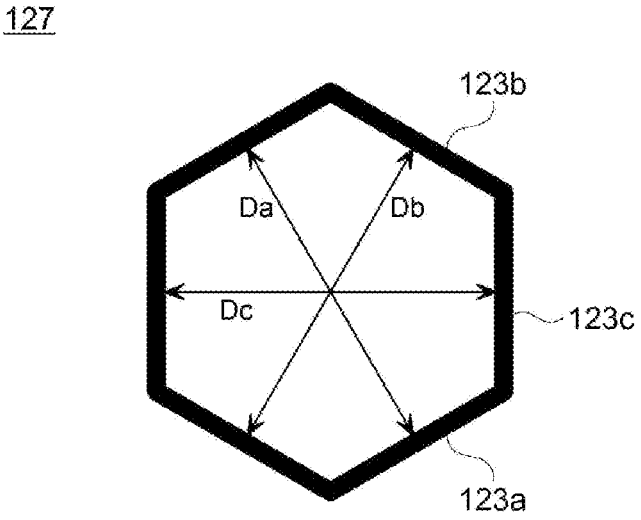
FIG. 5 is a schematic top planar view illustrating a unit cell of an antenna device in accordance with an exemplary embodiment.

FIG. 5 is a schematic top planar view illustrating a unit cell of an antenna device in accordance with an exemplary embodiment.

Referring to FIG. 5, a unit cell 127 may have a hexagonal shape. In this case, the unit cell 127 may include a first side 123*a*, a second side 123*b* and a third side 123*c* derived from electrode lines extending in three different directions. For example, the first side 123*a* and the second side 123*b* may extend in two diagonal directions, and the third side 123*c* may extend in a vertical direction.

The minimum distance between the opposite sides may include a distance Da between a pair of the first sides 123*a* facing each other, a distance Db between a pair of the second sides 123*b* facing each other, and a distance Dc between a pair of the third sides 123*c* facing each other.

In an exemplary embodiment, the distance Da between the first sides 123*a*, the distance Db between the second sides 123*b* and the distance Dc between the third sides 123*c* may be the same as or different from each other, and may each be from about 225 μm or less, preferably from about 20 to about 225 μm, and more preferably from about 50 to about 196 μm.

Figure 6:
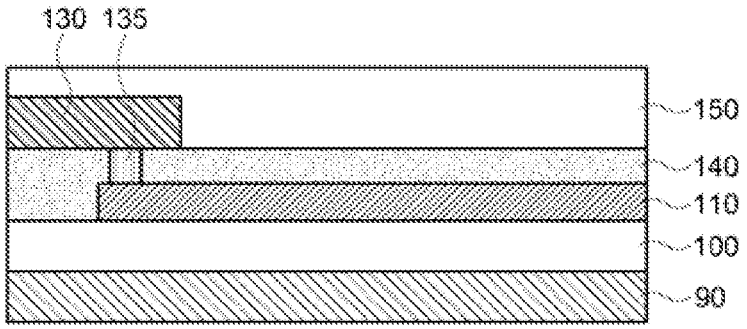
FIGS. 6 and 7 are a schematic cross-sectional view and a schematic top planar view, respectively, illustrating an antenna device in accordance with an exemplary embodiment.
Figure 7:
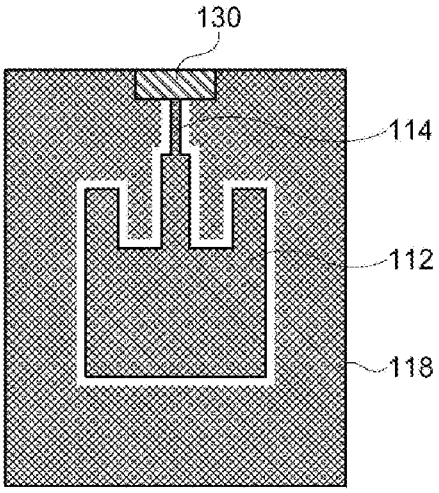

FIGS. 6 and 7 are a schematic cross-sectional view and a schematic top planar view, respectively, illustrating an antenna device in accordance with an exemplary embodiment.

Referring to FIGS. 6 and 7, the pad electrode 130 of the antenna device may have a solid structure instead of a mesh structure. Accordingly, a signal transmission/reception efficiency between the driving IC chip and the radiation pattern 112 may be improved and the signal loss may be suppressed.

As illustrated in FIG. 6, in some embodiments, a pad electrode 130 may be located at a different layer or a different level from that of an antenna pattern (e.g., the first electrode layer 110 including the radiation pattern 112 and the transmission line 114).

For example, the pad electrode 130 may be positioned at an upper level of the first electrode layer 110 and may be electrically connected to the first electrode layer 110 through a contact 135.

In an embodiment, an insulating interlayer 140 may be formed on the dielectric layer 100 to cover the first electrode layer 110. The contact 135 may be formed through the insulating interlayer 140 and may be electrically connected to the transmission line 114 included in the first electrode layer 110.

The pad electrode 130 may be disposed on the insulating interlayer 140 to be in contact with the contact 135. A protective layer 150 may be further formed on the insulating interlayer 140 to cover the pad electrode 130.

For example, a contact hole may be formed in the insulating interlayer 140 to partially expose an upper surface of the transmission line 114. Subsequently, a metal layer or an alloy layer filling the contact hole may be formed, and patterned to form the contact 135. In some embodiments, the contact 135 and the pad electrode 130 may be provided as a single member substantially integrally connected with each other. In this case, the contact 135 and the pad electrode 130 may be formed by the same patterning process for the metal film or the alloy film.

The insulating interlayer 140 and the protective layer 150 may include an inorganic insulating material such as silicon oxide, silicon nitride, etc., or an organic insulating material such as an acrylic resin, an epoxy-based resin, a polyimide-based resin, etc.

The pad electrode 130 may be disposed at a peripheral area such as a light-shielding portion or a bezel portion of a display device. Thus, the pad electrode 130 may not be visually recognized by a user and may be formed of a solid metal so that the signal loss may be suppressed. The radiation pattern 112 that may be disposed at a display area of the display device may be formed to include the above-described mesh structure to improve the transmittance and prevent the electrode visibility.

Figure 8:
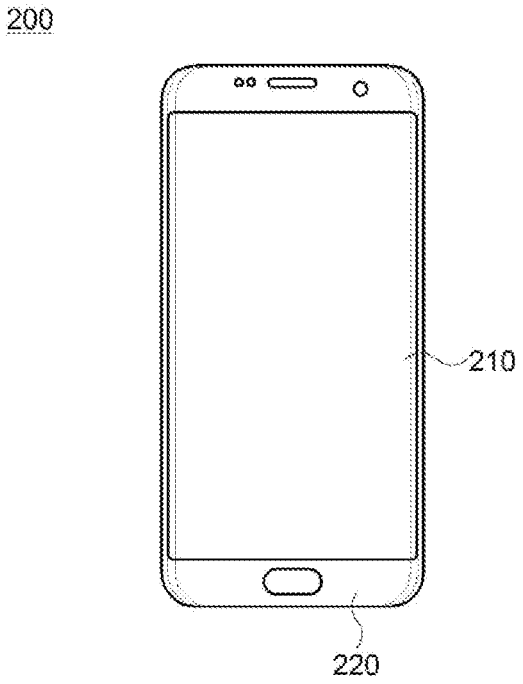
FIG. 8 is a schematic top planar view illustrating a display device in accordance with an exemplary embodiment.

FIG. 8 is a schematic top planar view illustrating a display device in accordance with an exemplary embodiment. For example, FIG. 8 illustrates an external shape including a window of a display device.

Referring to FIG. 8, a display device 200 may include a display area 210 and a peripheral area 220. For example, the peripheral area 220 may be positioned on both lateral portions and/or both end portions of the display area 210.

In some embodiments, the above-described antenna device may be inserted into the peripheral area 220 of the display device 200 in the form of a patch or a film. In some embodiments, the radiation pattern 112 of the antenna device as described above may be disposed to at least partially correspond to the display area 210 of the display device 200, and the pad electrode 116 and 130 may be disposed to correspond to the peripheral area 220 of the display device 200.

The peripheral area 220 may correspond to, e.g., a light-shielding portion or a bezel portion of an image display device. A driving circuit such as an IC chip of the display device and/or the antenna device may be disposed in the peripheral area 220.

The pad electrodes 116 and 130 of the antenna device may be disposed to be adjacent to the driving circuit, so that the signal loss may be suppressed by shortening a signal transmission/reception path.

In some embodiments, the dummy electrode 118 of the antenna device may be disposed on the display area 210. The radiation pattern 112 and the dummy electrode 118 may be formed to have the same mesh structure including, e.g., the unit cells described with reference to FIGS. 3 and 4, so that the improved transmittance may be effectively achieved while suppressing the electrode visibility.

Hereinafter, preferred embodiments are proposed to more concretely describe the present invention. However, the following examples are only given for illustrating the present invention and those skilled in the related art will obviously understand that these examples do not restrict the appended claims but various alterations and modifications are possible within the scope and spirit of the present invention. Such alterations and modifications are duly included in the appended claims.

Experimental Example 1: Evaluation of Electrode Visibility Depending on a Minimum Distance Between Opposite Sides of a Unit Cell

Examples and Comparative Examples

A mesh structure illustrated in FIG. 3 was formed on the dielectric layer using an alloy (APC) of silver (Ag), palladium (Pd), and copper (Cu). An electrode line was formed to have a line width of 3 μm and an electrode thickness (or a height) was 2000 Å. The minimum distance (indicated as "A" in Table 1) between opposite sides was adjusted by changing a diagonal length in an X-axis direction (indicated as "X" in Table 1) and a diagonal length in a Y-axis direction (indicated as "Y" in Table 1) to prepare film antenna samples of Examples and Comparative Examples. Transmittances and electrode visibilities of the samples were evaluated as described below.

(1) Measurement of Transmittance

Transmittances of the samples prepared by Examples and Comparative Examples were measured using a spectrophotometer (CM-3600A, Konica Minolta) at a wavelength of 550 nm.

(2) Evaluation of Electrode Visibility.

The samples prepared by Examples and Comparative Examples were observed by naked eyes to determine whether the electrode lines or the mesh structure were visually recognized. Specifically, the samples were observed by naked eyes of 10 panels, and the electrode visibility was evaluated by the number of panels who determined that the electrode patterns were clearly seen as described below.

◎: 0 panel of 10 panels

○: 1 to 3 panels of 10 panels

Δ: 4 to 5 panels of 10 panels x: 6 panels or more of 10 panels

The results are shown in Table 1 below.

TABLE 1

| | X (μm) | Y (μm) | A (μm) | Transmittance | Electrode Visibility |
|---|---|---|---|---|---|
| Example 1-1 | 20 | 40 | 22 | 69.3% | ○ |
| Example 1-2 | 40 | 80 | 45 | 83.9% | ○ |
| Example 1-3 | 50 | 100 | 56 | 87.0% | ◎ |
| Example 1-4 | 100 | 200 | 112 | 93.4% | ◎ |
| Example 1-5 | 150 | 300 | 168 | 95.6% | ◎ |
| Example 1-6 | 175 | 350 | 196 | 96.2% | ◎ |
| Example 1-7 | 200 | 400 | 224 | 96.5% | ○ |
| Comparative Example 1-1 | 15 | 30 | 17 | 82.5% | Δ |
| Comparative Example 1-2 | 210 | 420 | 234 | 96.8% | Δ |
| Comparative Example 1-3 | 225 | 550 | 297 | 97.3% | X |
| Comparative Example 1-4 | 300 | 600 | 335 | 97.8% | X |
| Comparative Example 1-5 | 400 | 800 | 447 | 98.3% | X |

Referring to Table 1, when the minimum distance between the opposite sides exceeded 225 μm, the transmittance increased but the electrode visibility was degraded. When the minimum distance between the opposite sides was about 20 μm or more, the visual recognition of the electrode was substantially prevented. When the minimum distance between the opposite sides was in a range from about 50 μm to about 225 μm (or 196 μm), the transmittance of 87% or more was achieved while substantially blocking the visual recognition of the electrode.

Experimental Example 2: Evaluation of Resistance and Signal Loss Depending on a Line Width of an Electrode Line

Examples and Comparative Examples

A mesh structure illustrated in FIG. 3 was formed on the dielectric layer using an alloy (APC) of silver (Ag), palladium (Pd), and copper (Cu). The minimum distance between the opposite sides facing each other was fixed to 196 μm as in Example 1-6 of Experimental Example 1, and the line width of the electrode line was changed to prepare samples of Examples and Comparative Examples.

A signal loss (S21 (dB)), a line resistance and a transmittance of each sample of Examples and Comparative Examples were measured.

Specifically, S-parameter was extracted at 28 GHz using a network analyzer to measure the signal loss. The line resistance was measured by a resistance simulation (Q3D tool) method. The transmittance was measured by the same method as that of Experimental Example 1. The results are shown in Table 2 below.

TABLE 2

| | Line Width (μm) | Signal Loss (S21, dB) | Line Resistance (Ω) | Transmittance |
|---|---|---|---|---|
| Example 2-1 | 0.5 | −3.0 | 22.5 | 98.9% |
| Example 2-2 | 2 | −2.5 | 19.5 | 97.6% |
| Example 2-3 | 4 | −2.6 | 17.6 | 93.5% |
| Example 2-4 | 5 | −2.3 | 15.8 | 90.5% |
| Comparative Example 2-1 | 0.4 | −3.3 | 23.6 | 93.4% |

TABLE 2-continued

| | Line Width (μm) | Signal Loss (S21, dB) | Line Resistance (Ω) | Transmittance |
|---|---|---|---|---|
| Comparative Example 2-2 | 5.5 | −2.1 | 14.7 | 88.6% |
| Comparative Example 2-3 | 6 | −2.0 | 13.8 | 87.8% |

Figure 9:
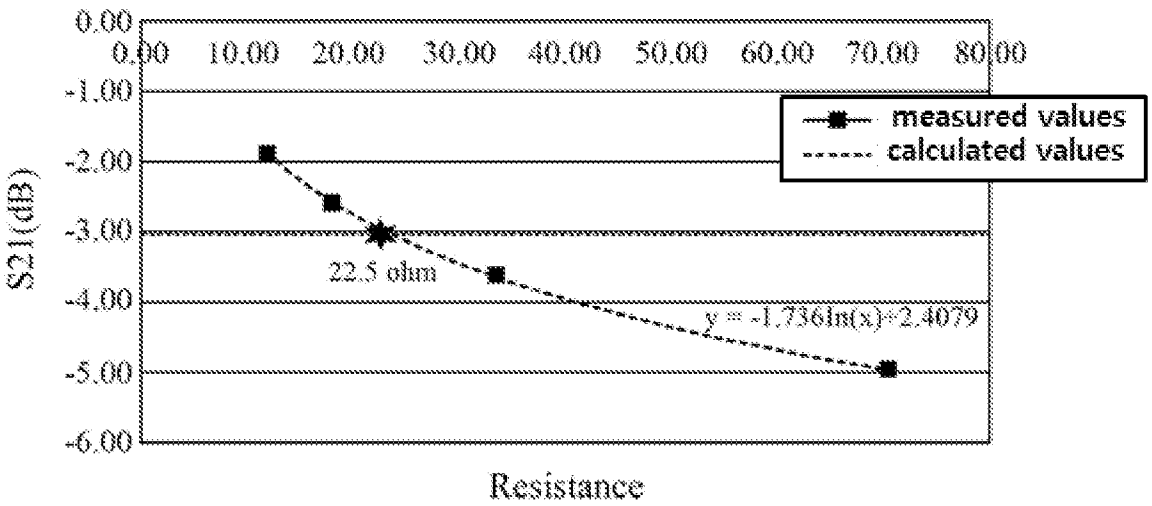
FIG. 9 is an exemplary graph showing a simulation result of a relation between a resistance and a signal loss level (S21).

FIG. 9 is an exemplary graph showing a simulation result of a relation between a resistance and a signal loss level (S21). Referring to FIG. 9, a target S21 representing an efficiency (an output intensity/an input intensity) of 50% or more was set as −3 dB and the resistance of an antenna pattern according to the target S21 was measured as 22.5Ω.

The target S21 is determined by Equation 1 below.

$$S21\ (\text{dB})=10*\text{Log}(\text{out intensity}/\text{input intensity}) \quad \text{[Equation 1]}$$

Referring to Table 2, the line width having the target signal efficiency was measured as 0.5 μm, and the target signal efficiency was not obtained when the line width of the electrode line became less than 0.5 μm. When the line width of the electrode line exceeded 5 μm, the transmittance of the antenna device became less than 90%.

What is claimed is:

1. An antenna device, comprising:

a dielectric layer; and a first electrode layer comprising an antenna pattern disposed on a top surface of the dielectric layer, the antenna pattern comprising a mesh structure in which unit cells defined by a plurality of electrode lines are assembled, wherein a minimum distance between opposite sides facing each other in the unit cell is from 20 μm to 225 μm, and a line width of the electrode line is from 0.5 μm to 5 μm, wherein the antenna pattern comprises a radiation pattern, a transmission line connected to the radiation pattern, and a pad electrode connected to an end portion of the transmission line.

2. The antenna device according to claim 1, wherein a minimum distance between opposite sides facing each other in the unit cell is from 50 μm to 196 μm.

3. The antenna device according to claim 1, wherein the plurality of electrode lines comprise first electrode lines and second electrode lines intersecting each other.

4. The antenna device according to claim 3, wherein the unit cell has a rhombus shape.

5. The antenna device according to claim 1, further comprising a dummy electrode arranged around the antenna pattern.

6. The antenna device according to claim 5, wherein the dummy electrode comprises the same mesh structure as that of the antenna pattern.

7. The antenna device according to claim 6, wherein the antenna pattern and the dummy electrode comprise the same metal.

8. The antenna device according to claim 1, wherein the radiation pattern comprises the mesh structure, and the pad electrode has a solid structure.

9. The antenna device according to claim 8, wherein the pad electrode is disposed at an upper level from the radiation pattern and the transmission line, and the antenna device further comprises a contact electrically connecting the pad electrode and the transmission line.

10. A display device comprising the antenna device according to claim 1.

11. An antenna device, comprising:

a dielectric layer;

a first electrode layer on a top surface of the dielectric layer, the first electrode layer comprising first electrode lines and second electrode lines intersecting each other, the first electrode layer having a mesh structure in which unit cells defined by the first electrode lines and second electrode lines are assembled; and a pad electrode connected to the first electrode layer, wherein the first electrode layer comprises a radiation pattern having the mesh structure, a transmission line connected to the radiation pattern, wherein the pad electrode is connected to an end portion of the transmission line and has a solid structure, wherein a minimum distance between opposite sides facing each other in the unit cell is from 20 μm to 225 μm, and a line width of the electrode line is from 0.5 μm to 5 μm.

12. The antenna device of claim 11, wherein the pad electrode is disposed at an upper level from the radiation pattern and the transmission line.

13. The antenna device of claim 12, further comprising:

an insulating interlayer formed on the dielectric layer to cover the first electrode layer; and a contact formed through the insulating interlayer to electrically connect the pad electrode and the transmission line, wherein the pad electrode is disposed on the insulating interlayer to be in contact with the contact.

14. The antenna device of claim 13, further comprising:

a protective layer on the insulating interlayer to cover the pad electrode.

15. The antenna device of claim 11, further comprising:

a second electrode layer on a bottom surface of the dielectric layer.

16. A display device comprising the antenna device according to claim 11.

* * * * *